US011668509B2

(12) United States Patent
Hirama et al.

(10) Patent No.: US 11,668,509 B2
(45) Date of Patent: Jun. 6, 2023

(54) CONTAINER REFRIGERATION APPARATUS

(71) Applicant: DAIKIN INDUSTRIES, LTD., Osaka (JP)

(72) Inventors: Yuuya Hirama, Osaka (JP); Makoto Ikemiya, Osaka (JP); Kazuyasu Matsui, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/687,007

(22) Filed: Mar. 4, 2022

(65) Prior Publication Data

US 2022/0187003 A1 Jun. 16, 2022

Related U.S. Application Data

(63) Continuation of application No. PCT/JP2020/025242, filed on Jun. 26, 2020.

(30) Foreign Application Priority Data

Sep. 30, 2019 (JP) ..... JP2019-180561

(51) Int. Cl.
*F25D 23/00* (2006.01)
*F25D 11/00* (2006.01)
(Continued)

(52) U.S. Cl.
CPC ..... *F25D 11/00* (2013.01); *F25D 19/003* (2013.01); *F25D 23/06* (2013.01)

(58) Field of Classification Search
CPC ..... F25D 19/003; F25D 23/066; F25D 23/02; F25D 23/06; F25D 2308/08221
See application file for complete search history.

(56) References Cited

U.S. PATENT DOCUMENTS 4,348,871 A 9/1982 Androff
8,418,867 B2 * 4/2013 Ikemiya ..... F25D 19/003 220/1.5
(Continued)

FOREIGN PATENT DOCUMENTS

EP 2 180 276 A1 4/2010
JP 56-70790 U 6/1981
(Continued)

OTHER PUBLICATIONS

JPH0694354 Translation.*
(Continued)

*Primary Examiner* — Brian M King
(74) *Attorney, Agent, or Firm* — Birch, Stewart, Kolasch & Birch, LLP

(57) ABSTRACT

Left and right edge portions of an external casing of a container refrigeration apparatus each include a column member that is continuous from the upper end to the lower end of a casing. Left and right edge portions of an internal casing each include a side plate that is continuous from the upper end to the lower end of the casing. The column members of the external casing and the associated side plates of the internal casing are fixed together, thereby increasing the strength of the casing including the external casing and the internal casing.

18 Claims, 10 Drawing Sheets

(51) Int. Cl.
*F25D 23/06* (2006.01)
*F25D 19/00* (2006.01)

(56) References Cited

U.S. PATENT DOCUMENTS

| | | | | |
|---|---|---|---|---|
| 2010/0127608 | A1 | 5/2010 | Kitamura et al. | |
| 2010/0192620 | A1 | 8/2010 | Ikemiya et al. | |
| 2011/0148266 | A1* | 6/2011 | Ikemiya | F25D 19/003 312/401 |
| 2012/0080162 | A1 | 4/2012 | Ikemiya et al. | |
| 2012/0085117 | A1* | 4/2012 | Ikemiya | B60H 1/3232 62/277 |

FOREIGN PATENT DOCUMENTS

| | | | |
|---|---|---|---|
| JP | 57-164809 | A | 10/1982 |
| JP | 63-123985 | U | 8/1988 |
| JP | 6-94354 | A | 4/1994 |
| JP | H0694354 | * | 4/1994 |
| JP | 11-14243 | A | 1/1999 |
| JP | 2006-207922 | A | 8/2006 |
| JP | 2008-37319 | A | 2/2008 |
| JP | 2008-275186 | A | 11/2008 |
| JP | 2009-24985 | A | 2/2009 |
| JP | 4281823 | B2 | 6/2009 |
| WO | WO 2010/143390 | A1 | 12/2010 |

OTHER PUBLICATIONS

English translation of the International Preliminary Report on Patentability and Written Opinion of the International Searching Authority for International Application No. PCT/JP2020/025242, dated Apr. 14, 2022.
Decision to Grant a Patent issued in Japanese Patent Application No. 2019-180561, dated Feb. 19, 2021.
International Search Report (PCT/ISA/210) issued in PCT/JP2020/025242, dated Aug. 18, 2020.
Notice of Reason for Refusal issued in Japanese Patent Application No. 2019-180561, dated Aug. 3, 2020.
Written Opinion of the International Searching Authority (PCT/ISA/237) issued in PCT/JP2020/025242, dated Aug. 18, 2020.
Extended European Search Report dated Sep. 29, 2022 in counterpart European Application No. 20871574.8.

* cited by examiner

CONTAINER REFRIGERATION APPARATUS

CROSS REFERENCE TO RELATED APPLICATIONS

This application is a Continuation of PCT International Application No. PCT/JP2020/025242, filed on Jun. 26, 2020, which claims priority under 35 U.S.C. 119(a) to Patent Application No. 2019-180561, filed in Japan on Sep. 30, 2019, all of which are hereby expressly incorporated by reference into the present application.

TECHNICAL FIELD

The present disclosure relates to a container refrigeration apparatus.

BACKGROUND ART

A container refrigeration apparatus has included a casing configured to close an opening of a container body (see, for example, Patent Document 1). This casing includes an external casing near the outside of the container body, and an internal casing near the inside of the container body. The internal casing is fitted to the side of the external casing near the inside of the container.

The casing has a lower portion having a protrusion that protrudes toward the inside of the container. The casing includes side plates extending from the lower end to the upper end of the protrusion. The casing has side plate extension parts which are separate from the respective side plates and which extend the respective side plates upward from the protrusion.

CITATION LIST

Patent Documents

Patent Document 1: Japanese Patent No. 4281823

SUMMARY

A first aspect of the present disclosure is directed to a container refrigeration apparatus including: a casing (11) fitted to an open end of a container body (1).

The container refrigeration apparatus according to the first aspect has the following features. The casing (11) includes an external casing (12) near outside of the container body (1), and an internal casing (13) near inside of the container body (1). The internal casing (13) is fixed to the external casing (12). Left and right edge portions of the external casing (12) each include a column member (50) that is continuous from an upper end to a lower end of the casing (11). Left and right edge portions of the internal casing (13) each include a side plate (41) that is continuous from the upper end to the lower end of the casing (11). The column member (50) and the associated side plate (41) are fixed together.

According to the first aspect, the column members (50) and the associated side plates (41) are fixed together. The column members (50) are provided on the left and right edge portions, respectively, of the external casing (12) to be continuous from the upper end to the lower end of the casing (11). The side plates (41) are provided on the left and right edge portions, respectively, of the internal casing (13) to be continuous from the upper end to the lower end of the casing (11). In the first aspect, the side plates (41) are continuous from the upper end to the lower end of the casing (11). This allows the casing (11) to be strong enough to withstand external forces, and can reduce the torsional deformation of the casing (11).

DESCRIPTION OF EMBODIMENTS

Embodiments of the present invention will now be described in detail with reference to the drawings. The following embodiments relate to a container refrigeration apparatus. Note that the following description of embodiments is merely an example in nature, and is not intended to limit the scope, applications, or use of the present invention.

Figure 1:
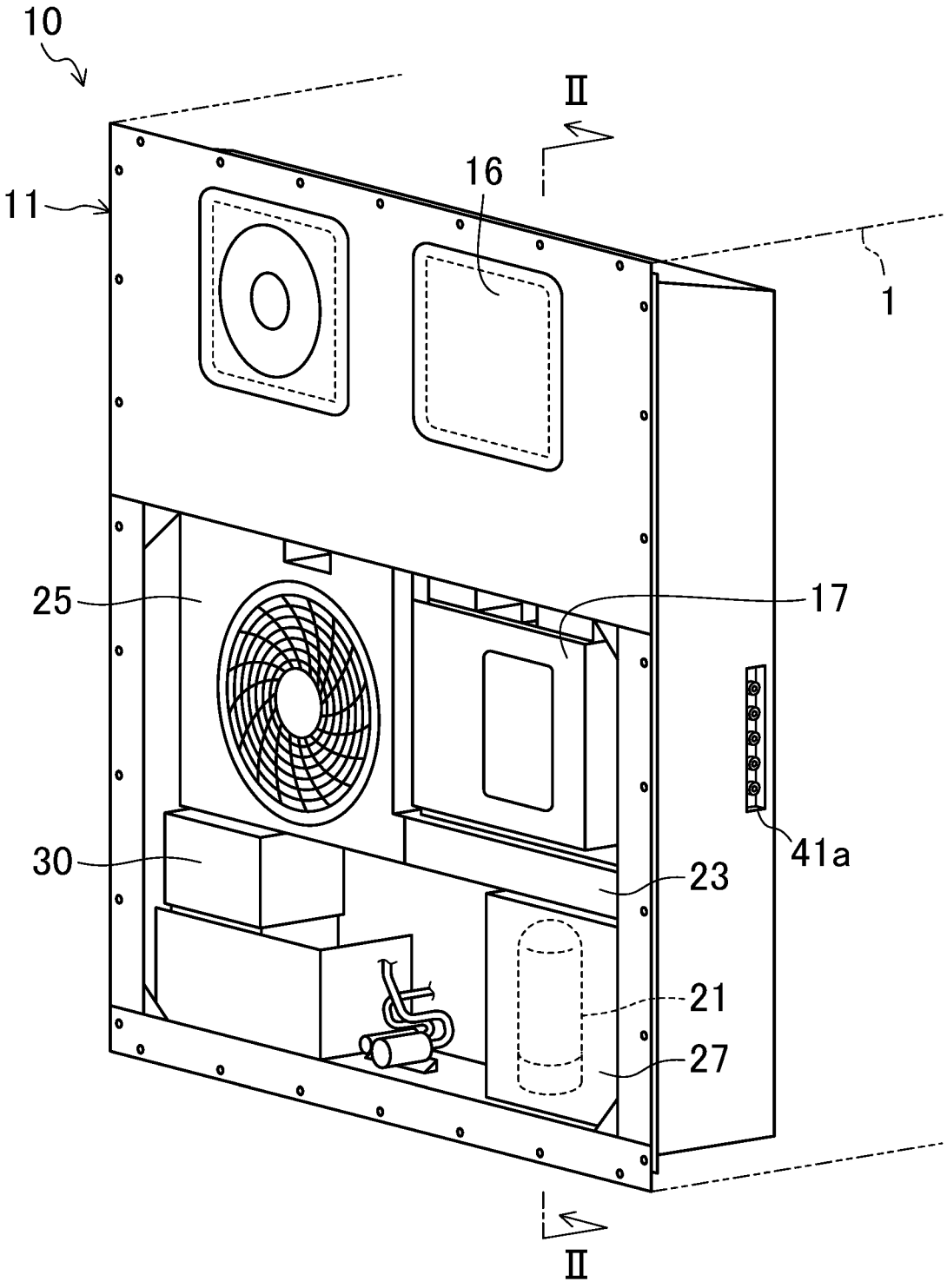
FIG. 1 is a perspective view illustrating a container refrigeration apparatus according to an embodiment as viewed from outside.
Figure 2:
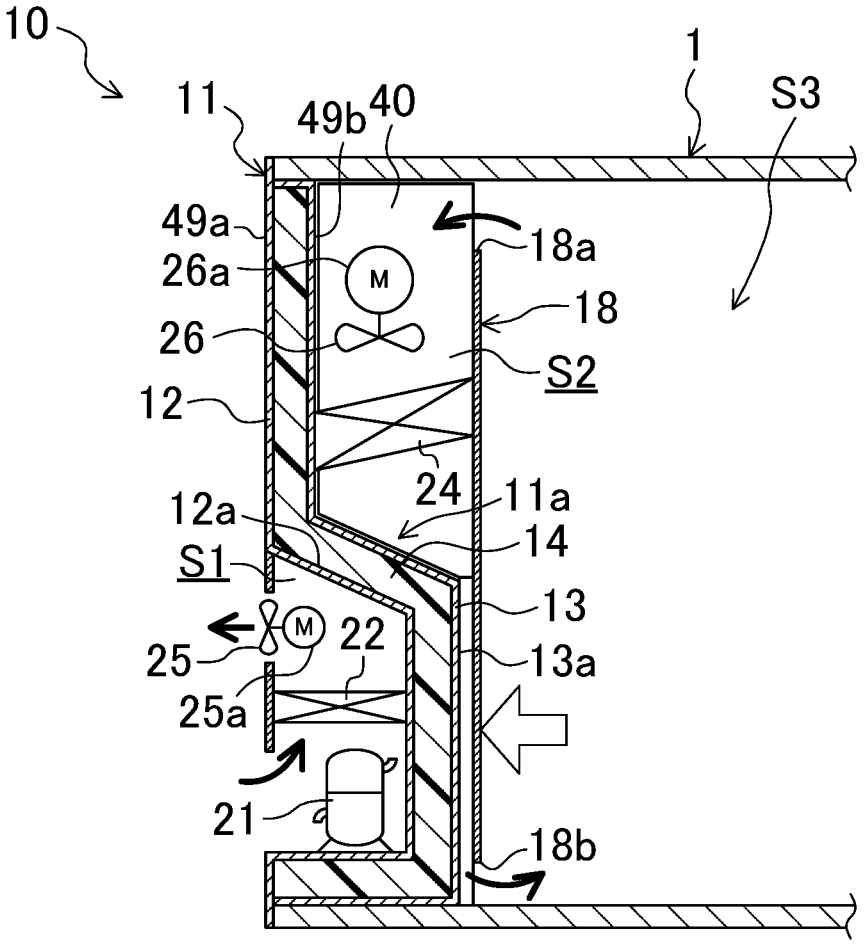
FIG. 2 is a cross-sectional view taken along line II-II shown in FIG. 1.

A container refrigeration apparatus (10) of this embodiment illustrated in FIGS. 1 and 2 refrigerates a cargo storage space (S3) for a container body (1) for use in marine transportation, for example. The container body (1) has the shape of a box with an open longitudinal end.

Figure 4:
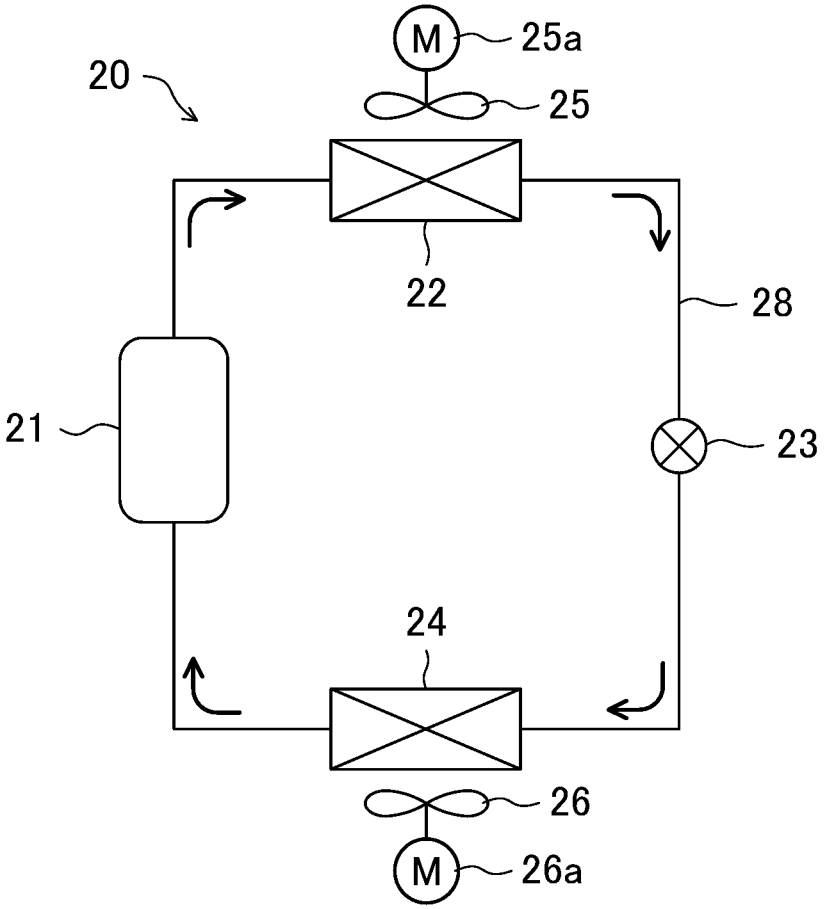
FIG. 4 is a piping system diagram illustrating a refrigerant circuit.

The container refrigeration apparatus (10) includes a refrigerant circuit (20) cooling air in an internal space (S2, S3) of the container body (1) using a refrigeration cycle (see FIG. 4). The internal space (S2, S3) of the container body (1) includes the cargo storage space (S3) in which plants (not shown), for example, are boxed and stored, and an internal storage space (S2) in which some of components of the refrigerant circuit (20) described below are stored.

Overall Structure of Container Refrigeration Apparatus

The container refrigeration apparatus (10) includes a casing (11). The casing (11) is attached to the open end of the box-shaped container body (1) to close the open end. The casing (11) includes an external casing (12) near the outside of the container body (1), and an internal casing (13) near the inside of the container body (1). The external casing (12) and the internal casing (13) are made of, for example, an aluminum alloy.

The external casing (12) is attached and fixed to the periphery of the opening of the container body (1) to close the open end of the container body (1). The external casing (12) has a lower portion having a first protrusion (12*a*) that protrudes toward the inside of the container body (1).

The internal casing (13) faces the external casing (12), and is fixed to the external casing (12). The internal casing (13) has a lower portion having a second protrusion (13*a*) that conforms to the lower portion of the external casing (12) to protrude toward the inside of the container. As illustrated in FIG. 2, the second protrusion (13*a*) covers the first protrusion (12*a*) from the inside of the container. A space between the internal casing (13) and the external casing (12) is filled with a thermal insulator (14).

While the external casing (12) and the internal casing (13) are combined together, the lower portion of the casing (11) has a protrusion (11*a*) formed by the first and second protrusions (12*a*) and (13*a*) and protruding toward the inside of the container body (1). A portion of the casing (11) near the outside of the container body (1) has an external storage space (S1) inside the first protrusion (12*a*). A portion of the casing (11) near the inside of the container body (1) has the internal storage space (S2) above the second protrusion (13*a*).

The casing (11) is provided with two opening/closing doors (16), which are arranged side by side in a width direction, and can open and close at the time of maintenance. The external storage space (S1) of the casing (11) includes an electric component box (17) adjacent to an external fan (25) described below.

Figure 3:
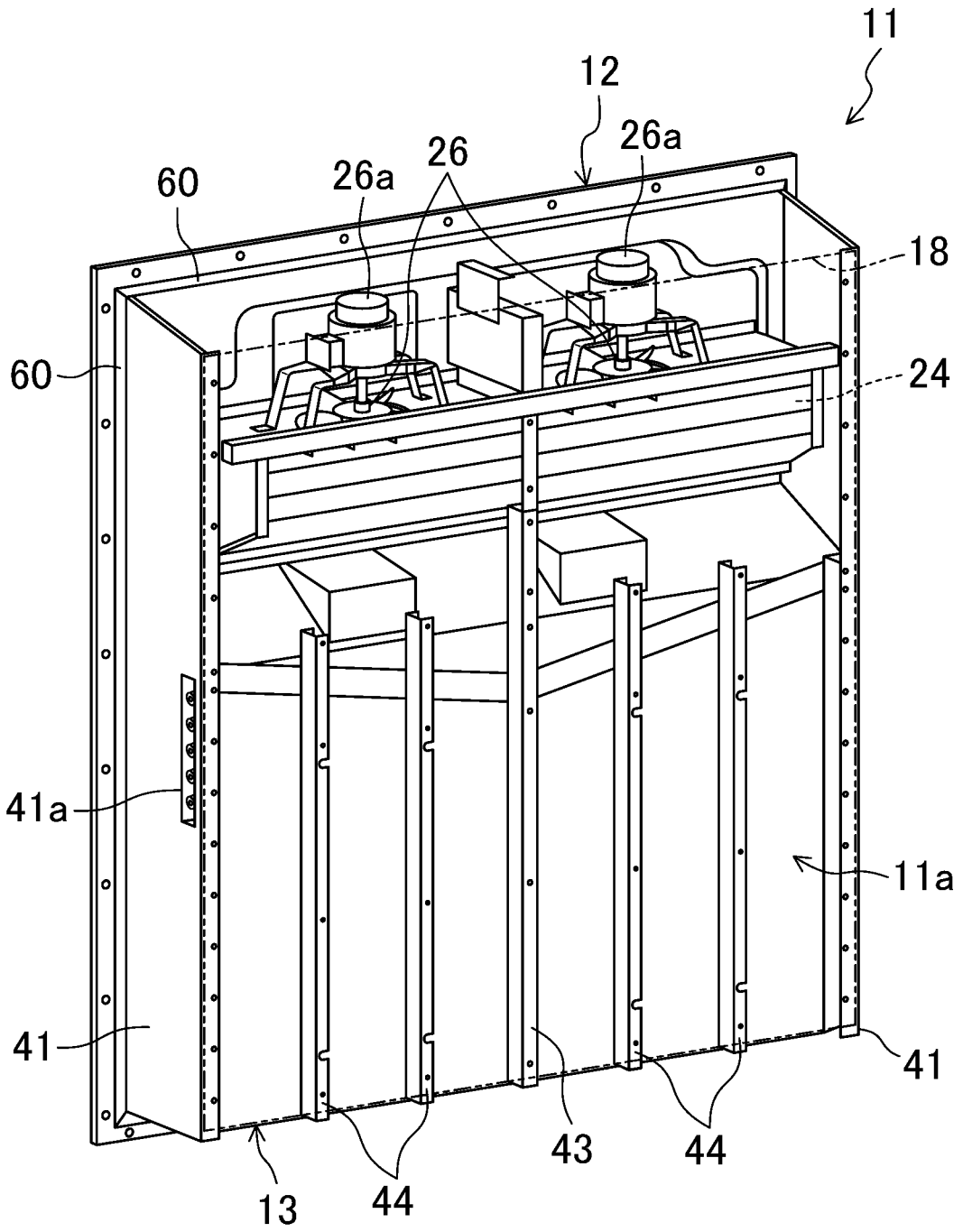
FIG. 3 is a perspective view illustrating a container refrigeration apparatus from which a partition plate is detached as viewed from inside.

As shown in FIG. 2, a partition plate (18) is disposed on the side of the casing (11) near the inside of the container. This partition plate (18) is configured as a substantially rectangular plate member, and is spaced apart from, and faces, the inner surface of the casing (11). This partition plate (18) separates the internal storage space (S2) from the cargo storage space (S3) in the container body (1). The partition plate (18) indicated by the phantom lines in FIG. 3 is supported by side plates (41), a center stay (43), and side stays (44) of the casing (11).

An intake port (18*a*) is formed between the upper end of the partition plate (18) and a ceiling surface of the container body (1). Air in the cargo storage space (S3) of the container body (1) is taken into the internal storage space (S2) through the intake port (18*a*). The lower end of the partition plate (18) has an outlet (18*b*) through which air is blown into the cargo storage space (S3).

As shown in FIG. 4, the container refrigeration apparatus (10) includes the refrigerant circuit (20) that allows a refrigerant to circulate therethrough to perform a vapor compression refrigeration cycle. The refrigerant circuit (20) is a closed circuit including a compressor (21), a condenser (radiator) (22), an expansion valve (expansion mechanism) (23), and an evaporator (24), which are connected together in this order through a refrigerant pipe (28).

As shown in FIGS. 1 and 2, the compressor (21) and the condenser (external heat exchanger) (22) are housed in the external storage space (S1). An external fan (25) is disposed above the condenser (22). The external fan (25) is driven in rotation by an external fan motor (25*a*), guides air outside the container body (1) into the external storage space (S1), and sends the guided air to the condenser (22). The condenser (22) exchanges heat between a refrigerant inside the condenser (22) and outside air.

The evaporator (24) is housed in the internal storage space (S2). As shown in FIG. 3, two internal fans (26) adjacent to each other in a width direction of the casing (11) are disposed above the evaporator (24) in the internal storage space (S2). Each internal fan (26) is driven in rotation by an internal fan motor (26*a*), guides inside air in the container body (1) from the intake port (18*a*), and blows the air to the evaporator (24). The evaporator (24) exchanges heat between a refrigerant flowing therethrough and the inside air. The inside air dissipates heat to the refrigerant while passing through the evaporator (24). The cooled inside air is blown through the outlet (18*b*) to the cargo storage space (S3) of the container body (1). The side plates (41) of the casing (11) each have openings (41*a*) through each of which a cable for a temperature sensor (not shown) provided inside the container is drawn.

The container refrigeration apparatus (10) of this embodiment includes a mixed gas supply device (30) configured to supply mixed gas with a low oxygen concentration to the cargo storage space (S3) of the container body (1) to adjust the oxygen concentration in the internal space (S2, S3). The mixed gas supply device (30) is unitized and disposed at the lower left corner of the external storage space (S1), as shown in FIG. 1. The compressor (21) and a compressor cover (27) are disposed on the right side of the mixed gas supply device (30).

Specific Structures of External and Internal Casings

The protrusion (11*a*) of the casing (11) includes the first protrusion (12*a*) of the external casing (12) and the second protrusion (13*a*) of the internal casing (13) as described above. The protrusion (11*a*) forms part of the lower portion of the casing (11) between left and right edge portions of the casing (11) to protrude toward the inside of the container body (1).

Figure 5:
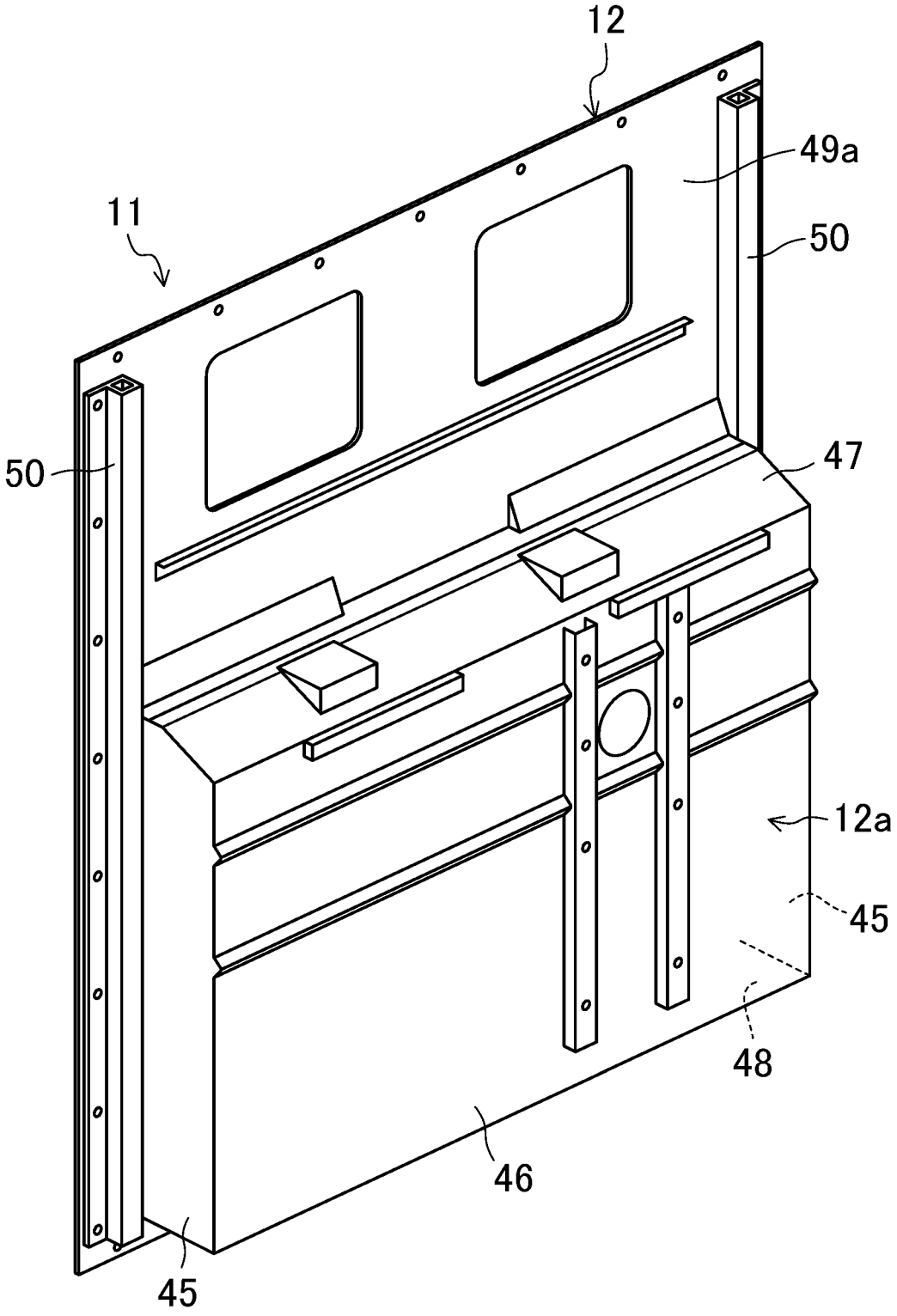
FIG. 5 is a perspective view of an external casing as viewed from inside.

As shown in FIG. 5, the first protrusion (12*a*) of the external casing (12) includes left and right first side plates (45), a first back plate (46), a first top plate (47), and a first bottom plate (48), which are sheet metal components. A space surrounded by the first side plates (45), the first back plate (46), the first top plate (47), and the first bottom plate (48) is the external storage space (S1).

Figure 6:
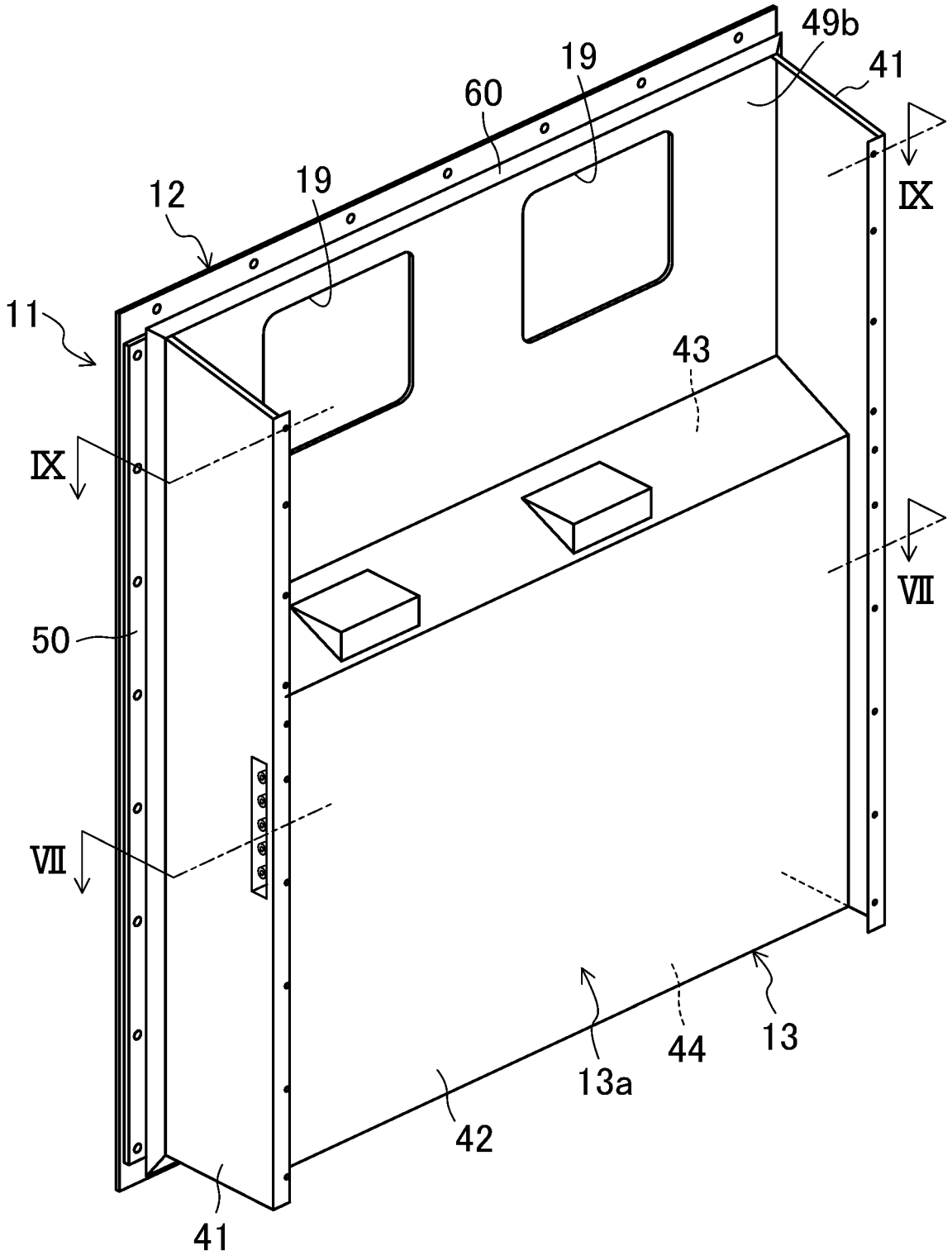
FIG. 6 is a perspective view of a casing that includes an external casing and an internal casing covering the external casing, as viewed from inside.

As shown in FIG. 6, the second protrusion (13*a*) of the internal casing (13) includes left and right second side plates (41), a second back plate (42), a second top plate (43), and a second bottom plate (44), which are sheet metal components. The internal storage space (S2) is formed above the second top plate (43). The second side plates (41) are each a member that is continuous from the upper end to the lower end of the casing (11), and are integrated with the associated side surfaces of the second protrusion (13*a*) of the internal casing (13). Additionally speaking, the second side plates (41) are integrated with the associated side surfaces of the protrusion (11*a*) of the casing (11).

The second side plates (41) are the thickest of the sheet metal components combined together to form the internal casing (13) (the second side plates (41), the second back plate (42), the second top plate (43), and the second bottom plate (44)).

Figure 7:
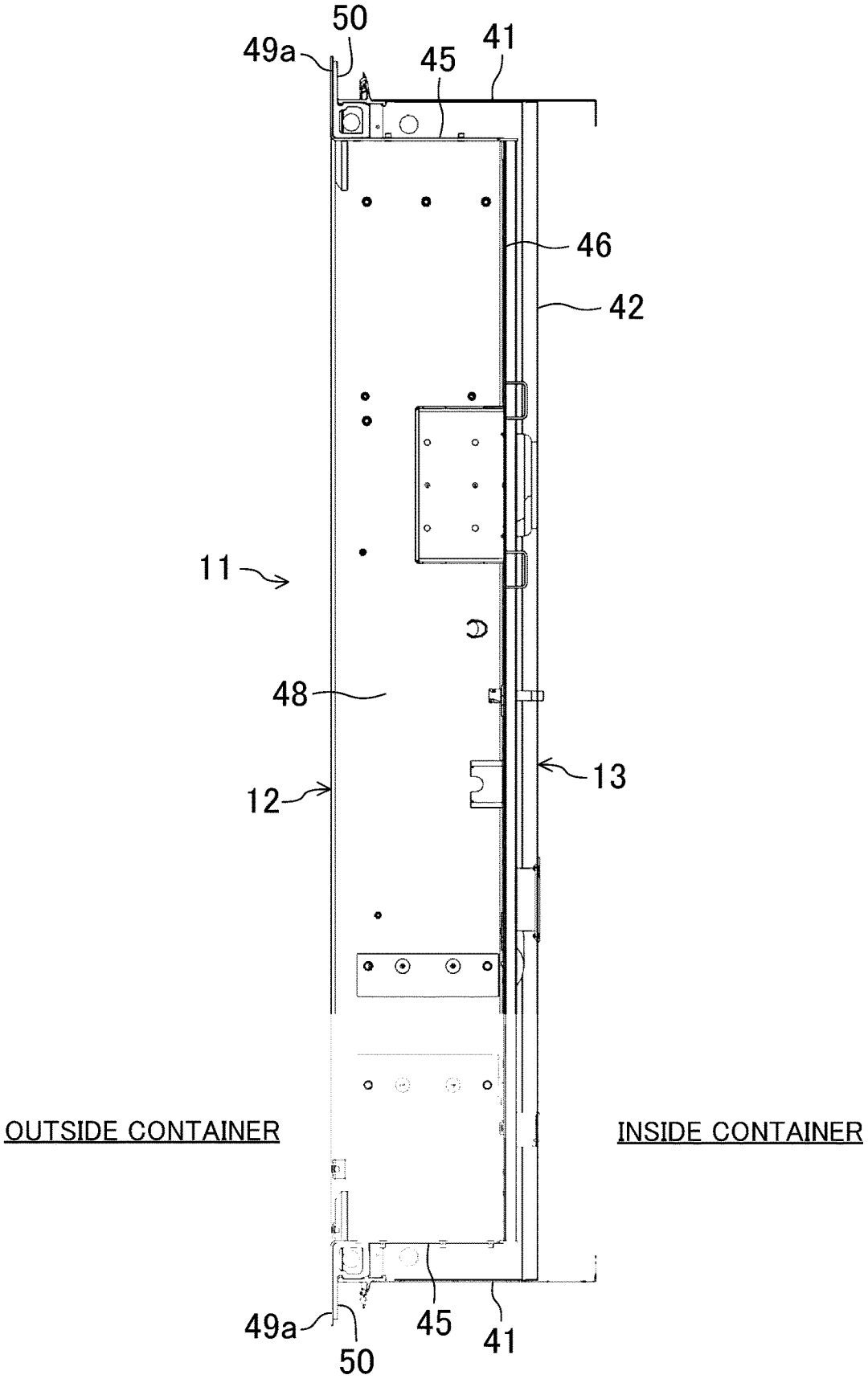
FIG. 7 is a cross-sectional view of the casing taken along line VII-VII in FIG. 6, as viewed from above.
Figure 8:
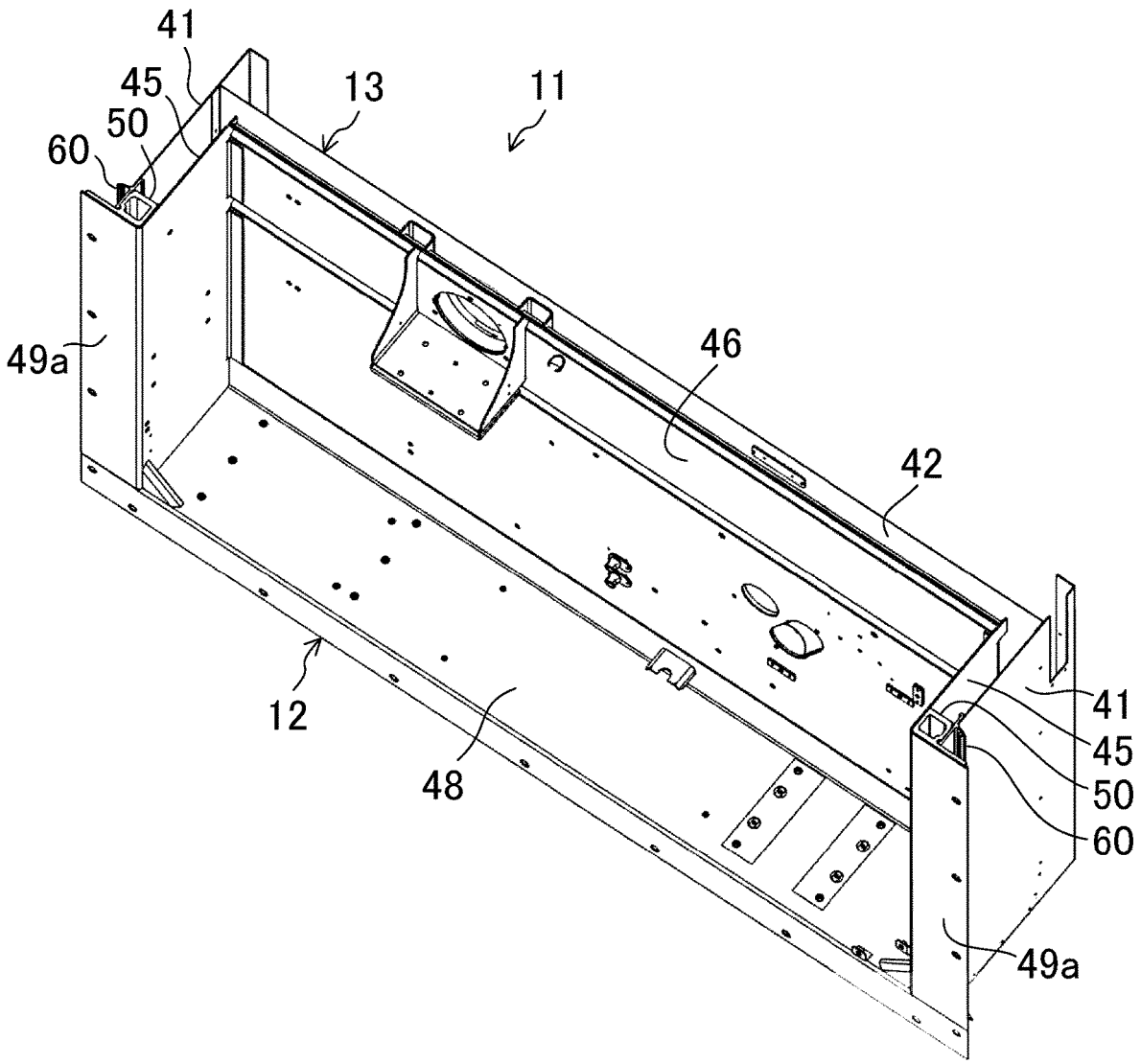
FIG. 8 is a perspective view of the same cross section of the casing as that illustrated in FIG. 7.

As shown in FIGS. 7 and 8, which are respectively a cross-sectional view of the casing (11) taken along line VII-VII in FIG. 6 as viewed from above and a perspective view of the same cross section of the casing (11) as that illustrated in FIG. 7, the first side plates (45) are spaced apart from, and faces, the associated second side plates (41). The first back plate (46) is also spaced apart from, and also faces, the second back plate (42). Further, as is clear from FIG. 2, the first top plate (47), the first bottom plate (48), and a first front panel (49*a*) are also spaced apart from, and also face, the second top plate (43), the second bottom plate (44), and a second front panel (49*b*), respectively. The space defined by these components is filled with the thermal insulator (14).

As shown in FIG. 5, left and right edge portions of the external casing (12) include respective column members (50) that are continuous from the upper end to the lower end of the casing (11). As shown in FIG. 6, left and right edge portions of the internal casing (13) include the respective second side plates (41) that are continuous from the upper end to the lower end of the casing (11). In the casing (11) of this embodiment, the column members (50) are fixed to the associated second side plates (41).

The casing (11) of the container refrigeration apparatus (10) of this embodiment includes intermediate members (60) interposed between the external casing (12) and the internal casing (13) and fixed to the associated column members (50) and the associated second side plates (41). The intermediate members (60) are made of a resin material (e.g., polyvinyl chloride) having a lower thermal conductivity than the column members (50) and the second side plates (41) made of a metal material do. The intermediate members (60) are quadrilateral frame-shaped resin members formed to substantially prevent the external and internal casings (12) and (13) from coming into contact with each other at the right and left side edges, upper edge, and lower edge of the casing (11).

Figure 9:
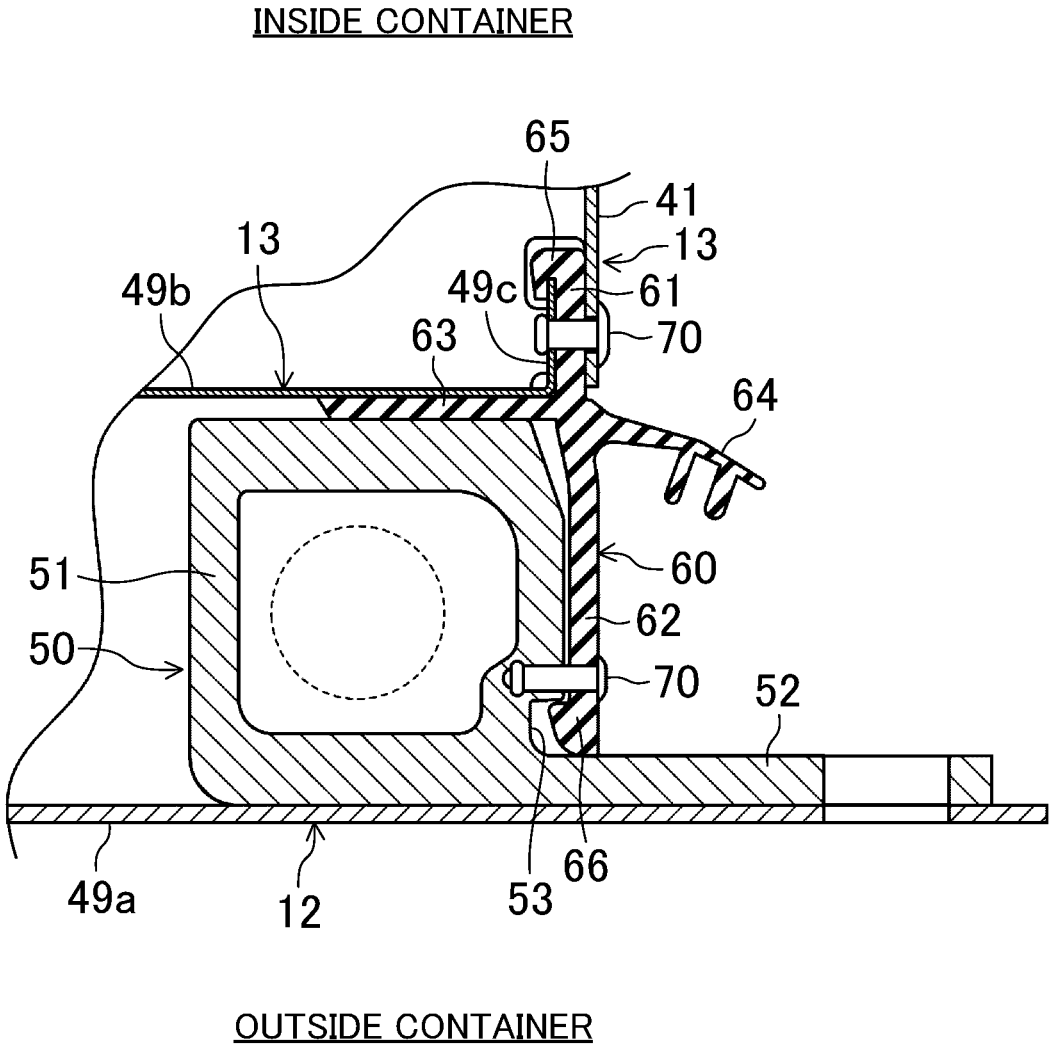
FIG. 9 is an enlarged cross-sectional view of a joint between a column member and a side plate (taken along line IX-IX in FIG. 6).

The structure of attachment of the intermediate members (60) to the associated column members (50) and the associated second side plates (41) will be described with reference to FIG. 9. FIG. 9 is an enlarged view of a cross section of the structure of attachment taken along line IX-IX in FIG. 6. The cross section taken along line IX-IX is a cross section taken along substantially the centerlines, in the height direction, of the openings (19) of the first and second front panels (49*a*) and (49*b*) corresponding to the opening/closing doors (16). A portion of the casing (11) above the upper end of the protrusion (11*a*) has the illustrated cross-sectional structure. A portion of the casing (11) below the upper end of the protrusion (11*a*) has a different cross-sectional structure as described below. Each column member (50) is an extrusion molded product of an aluminum alloy, and includes a tubular column body (51), and a plate-shaped attachment portion (52) to be fixed to the external casing (12). The column body (51) and the attachment portion (52) are integrated together to form the column member (50) with a "P"-shaped cross section.

As shown in FIG. 9, each intermediate member (60) has a cross section with a shape similar to the shape of a plus sign (+). The upper side of the intermediate member (60) in the same drawing constitutes a first fastener (61) configured to fasten the intermediate member (60) to the internal casing (13). The lower side of the intermediate member (60) in the same drawing constitutes a second fastener (62) configured to fasten the intermediate member (60) to the external casing (12). The left side of the intermediate member (60) in the same drawing constitutes a thermal insulator (63) sandwiched between the external and internal casings (12) and (13). The right side of the intermediate member (60) in the same drawing constitutes a seal portion (64) to be used when the casing (11) is fitted to the container body (1).

Figure 10:
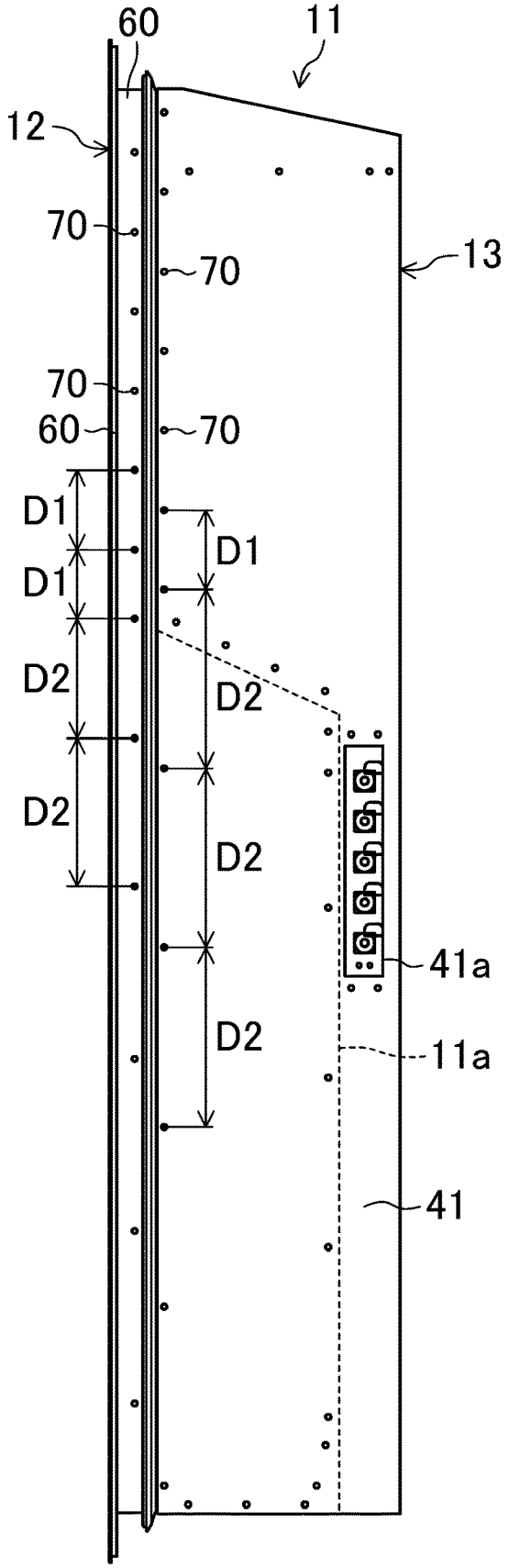
FIG. 10 is a side view of the casing.

The column members (50) of the external casing (12) are fixed to the associated intermediate members (60) through a plurality of rivets (70) serving as fastening members, and so are the second side plates (41) of the internal casing (13). As shown in FIG. 10, which is a side view of the casing (11), the rivets (70) are vertically spaced apart from one another. The distance (D1) between each adjacent pair of some of the rivets (70) arranged above the protrusion (11*a*) is shorter than the distance (D2) between each adjacent pair of the other rivets (70) arranged within the range from the lower end to the upper end of the protrusion (11*a*).

The internal casing (13) has plate-shaped edge portions (49*c*) each formed by bending an associated one of left and right edge portions of the second front panel (49*b*). The plate-shaped edge portions (49*c*) extend in the top-to-bottom direction of the internal casing (13). The first fastener (61) of each intermediate member (60) has a hook portion (65) having a U-shaped cross section and hooked on an associated one of the plate-shaped edge portions (49*c*). The hook portion (65) extends in the top-to-bottom direction of the internal casing (13).

Portions of the intermediate members (60) forming the left and right edge portions of the respective frames have the same cross-sectional shape as a whole in the top-to-bottom direction of the casing. In addition, the entire intermediate members (60) forming the respective frames including their upper and lower edge portions also have the same cross-sectional shape.

In contrast, the second front panel (49*b*) of the internal casing (13) is provided only above the protrusion (11*a*), and is not provided below the upper end of the protrusion (11*a*). Thus, the plate-shaped edge portions (49*c*) are absent below the upper end of the protrusion (11*a*). A cross section of a portion of the casing below the upper end of the protrusion (11*a*) is different from the cross section shown in FIG. 9 in that the plate-shaped edge portions (49*c*) are absent below the upper end of the protrusion (11*a*) as described above. Since the plate-shaped edge portions (49*c*) are absent below the upper end of the protrusion (11*a*), the first fasteners (61) are fastened to the associated second side plates (41) such that their hook portions (65) pinch the respective plate-shaped edge portions (49*c*) only above the protrusion (11*a*), whereas the first fasteners (61) are fastened to the associated second side plates (41) only through the rivets (70) below the upper end of the protrusion (11*a*).

A surface of each of the column members (50) of the external casing (12) located near the outer end of an associated one of the left and right edge portions of the external casing (12) has a groove (53) that extends in the top-to-bottom direction of the column body (51). The second fastener (62) of each intermediate member (60) has a projection (66) that fits in the groove (53) of the associated column member (50). The projection (66) extends in the top-to-bottom direction of the external casing (13). Each column member (50) extends across the casing (11) in the top-to-bottom direction of the casing (11). Thus, the second fastener (62) is fastened to the associated column member (50) through the rivets (70) and the projection (66) as a whole in the top-to-bottom direction of the casing (11).

Operation

During operation of the container refrigeration apparatus (10) of this embodiment, the compressor (21) of the refrigerant circuit (20) is started so that the refrigeration cycle is performed in the refrigerant circuit (20). The refrigerant circulates through the refrigerant circuit (20), and repeats the cycle of evaporating through absorption of heat from inside air in the evaporator (24) while condensing through dissipation of heat to outside air in the condenser (22). Air in the internal space (S2, S3) is circulated between the cargo storage space (S3) and the internal storage space (S2) by the internal fan (26), and is cooled by the refrigerant absorbing heat while passing through the evaporator (24).

Advantages of First Embodiment

In this embodiment, the left and right edge portions of the external casing (12) each include the column member (50)

that is continuous from the upper end to the lower end of the casing (11). The left and right edge portions of the internal casing (13) each include the side plate (41) that is continuous from the upper end to the lower end of the casing (11). In this embodiment, the column members (50) and the associated side plates (41) are fixed together.

An internal casing of a known container refrigeration apparatus is typically made of fiber-reinforced plastics. Only portions of side plates of a casing corresponding to a protrusion are integrated with the internal casing, and plate-shaped members (side plate extension parts) that are separate from the side plates are attached to a portion of the casing above the protrusion. As can be seen, in the known container refrigeration apparatus, the side plate extension parts that are separate from the side plates are attached above the associated side plates for the protrusion. This makes it difficult for the casing to be strong enough. In other words, it is difficult for the casing of the known container refrigeration apparatus to be rigid enough to withstand external forces which are exerted during transportation of the container or at any other similar timings and which act to torsionally deform the casing.

In contrast, in this embodiment, the structure in which the column members (50) and the associated second side plates (41) are fixed together is used. The column members (50) are provided on the left and right edge portions, respectively, of the external casing (12) to be continuous from the upper end to the lower end of the casing (11). The second side plates (41) are provided on the right and left edge portions, respectively, of the internal casing (13) to be continuous from the upper end to the lower end of the casing (11). In this embodiment, since the second side plates (41) are continuous from the upper end to the lower end of the casing (11), both the side plates (41) and the column members (50) counteract external forces. In other words, in this embodiment, the side plates that have not functioned as strength members are modified into members that are continuous from the upper end to the lower end of the casing. Thus, the modified side plates are used as strength members. This can increase the strength of the casing (11) of the container refrigeration apparatus (10) of this embodiment against external forces, and can reduce the torsional deformation of the casing (11).

In this embodiment, lower portions of the second side plates (41) are integrated with the side surfaces, respectively, of the second protrusion (13*a*) of the internal casing (13). Additionally speaking, the lower portions of the second side plates (41) are integrated with the side surfaces, respectively, of the protrusion (11*a*) of the casing (11).

As can be seen, integrating the second side plates (41) with the protrusion (11*a*) of the casing (11) allows the second side plates (41) of the internal casing (13) to function also as the side surfaces of the protron (11*a*). This can simplify the configuration of the casing (11), and allows the casing (11) to be strong enough.

In this embodiment, the internal casing (13) includes the sheet metal components (41 to 44) combined together. Each second side plate (41) is one of the sheet metal components (41 to 44), and is the thickest of the sheet metal components (41 to 44).

According to this configuration, since the second side plates (41) are the thickest of the sheet metal components (41 to 44) of the casing (11), the second side plates (41) themselves have high rigidity. This can increase the strength of the casing (11) to an adequate degree. In addition, the internal casing (13) configured as a combination of the sheet metal components can reduce cost as compared with the internal casing (13) made of fiber-reinforced plastics (FRP).

In this embodiment, both the external casing (12) and the internal casing (13) are made of a metal material. The casing (11) includes the intermediate members (60) interposed between the external casing (12) and the internal casing (13) and fixed to the associated column members (50) and the associated second side plates (41). The intermediate members (60) are made of a resin material having a lower thermal conductivity than the column members (50) and the second side plates (41) do.

According to this configuration, the intermediate members (60) provided between the internal casing (12) and the external casing (13) and having a low thermal conductivity make it difficult for external heat to be transferred from the external casing (12) to the internal casing (13). As a result, for example, if the internal space is cooled to about 0° C. in a high-temperature environment where the outdoor air temperature is about 35° C., heat outside the container can be substantially prevented from being transferred from the external casing (12) to the internal casing (13).

According to the foregoing configuration, both the external casing (12) and the internal casing (13) are made of a metal material, and have high strength. This can reduce the load applied to the intermediate members made of a resin material.

In this embodiment, the column members (50) and the associated intermediate members (60) are fixed together through the rivets (70) vertically spaced apart from one another, and so are the side plates (41) and the associated intermediate members (60). In particular, the distance between each adjacent pair of some of the rivets (70) arranged above the protrusion (11*a*) is shorter than the distance between each adjacent pair of the other rivets (70) arranged within the range from the lower end to the upper end of the protrusion (11*a*).

According to this configuration, the intermediate members (60) made of a resin material can be firmly fastened to the associated column members (50) and the associated second side plates (41) using the rivets (70). In addition, the distance between each adjacent pair of the some of the rivets (70) arranged above the upper end of the protrusion (11*a*) (i.e., within the area where the protrusion (11*a*) is absent) is set to be shorter than the distance between each adjacent pair of the other rivets (70) arranged within the range from the upper end to the lower end of the protrusion (11*a*) (i.e., within the area where the protrusion (11*a*) is present). The absence of the protrusion (11*a*) may reduce the fastening strength above the protrusion (11*a*). However, shortening the distance allows the fastening strength to be high enough.

In this embodiment, the intermediate members (60) each have the first fastener (61) configured to be fastened to the internal casing (13). The internal casing (13) has the plate-shaped edge portions (49*c*) extending in the top-to-bottom direction thereof. The first fasteners (61) each have the hook portion (65) extending in the top-to-bottom direction. The hook portion (65) has a U-shaped cross section, and is hooked on the associated plate-shaped edge portion (49*c*).

According to this configuration, the intermediate members (60) are fastened to the internal casing (13) through the associated first fasteners (61) in addition to the fastening members (70). If the rivets (70) are used, the intermediate members (60) made of resin each have through holes through each of which an associated one of the fastening members (70) is passed. This may cause cracks to extend from areas surrounding the through holes of the intermediate members (60). In contrast, in this embodiment, the simply configured first fasteners (61), which also experience forces, reduce cracks.

In this embodiment, the intermediate members (60) each have the second fastener (62) configured to be fastened to the external casing (12). The column members (50) of the external casing (12) each have the groove (53) extending in the top-to-bottom direction. The second fasteners (62) each have the projection (66) extending in the top-to-bottom direction and fitting in the groove (53) of the associated column member (50).

In this embodiment, the intermediate members (60) are fastened to the external casing (12) through the associated second fasteners (62) in addition to the fastening members (70). If the fastening members (70), such as the rivets, are used, the intermediate members (60) made of resin each have through holes through each of which an associated one of the fastening members (70) is passed. This may cause cracks to extend from areas surrounding the through holes of the intermediate members (60). In contrast, in this embodiment, the simply configured second fasteners (62), which also experience forces, reduce cracks.

As can be seen from the foregoing description, according to this embodiment, the intermediate members (60) made of resin are not only fixed to the associated column members (50) and the associated side plates (41) through the rivets (70), but also each provided with the hook portion (65) and the projection (66). The hook portion (65) has a U-shaped cross section, and is hooked on the associated plate-shaped edge portion (49*c*). The projection (66) fits in the groove (53) of the associated column member (50). Thus, the load is substantially prevented from being concentrated on portions of the intermediate members. This reduces damage to the intermediate members.

Other Embodiments

The above-described embodiment may be modified as follows.

In the foregoing embodiment, the second side plates (41) of the internal casing (13) are integrated with the associated side surfaces of the protrusion (11*a*). A lower portion of the entire top-to-bottom length of each of the second side plates (41) corresponding to the protrusion (11*a*) may be superimposed over, and fixed to, a different member forming an associated side surface of the protrusion (11*a*), thereby integrating the second side plates (41) and the protrusion (11*a*) together.

In the foregoing embodiment, the second side plates (41) of the internal casing (13) are the thickest of the sheet metal members (41 to 44) of the internal casing (13). As long as the casing is strong enough, the second side plates (41) do not have to be the thickest of the sheet metal members (41 to 44).

In the foregoing embodiment, the configuration of the hook portion (65) of each first fastener (61) may be changed depending on the configuration of the internal casing (13). The configuration of the projection (66) of each second fastener (62) may be changed depending on the configuration of the external casing (12).

While the embodiment and variations have been described above, it will be understood that various changes in form and details can be made without departing from the spirit and scope of the claims. The above embodiment and variations may be appropriately combined or replaced as long as the functions of the target of the present disclosure are not impaired.

INDUSTRIAL APPLICABILITY

As can be seen from the foregoing description, the present disclosure is useful for a container refrigeration apparatus.

EXPLANATION OF REFERENCES

1 Container Body
10 Container Refrigeration Apparatus
11 Casing
11*a* Protrusion
12 External Casing
13 Internal Casing
41 Side Plate
49*c* Plate-Shaped Edge Portion
50 Column Member
53 Groove
60 Intermediate Member
61 First Fastener
62 Second Fastener
65 Hook Portion
66 Projection
70 Rivet (Fastening Member)

The invention claimed is:

1. A container refrigeration apparatus comprising:

a casing fitted to an open end of a container body, the casing including an external casing near outside of the container body, and an internal casing near inside of the container body, the internal casing being fixed to the external casing, left and right edge portions of the external casing each including a column member that is continuous from an upper end to a lower end of the casing, left and right edge portions of the internal casing each including a side plate that is provided from the upper end to the lower end of the casing, the side plate positioned on the right edge portion of the internal casing corresponding to the column member positioned on the right edge portion of the external casing, the side plate positioned on the left edge portion of the internal casing corresponding to the column member positioned on the left edge portion of the external casing, the side plates being fixed to the corresponding one of the column members, wherein the internal casing has a protrusion forming part of a lower portion of the casing between the left and right edge portions of the internal casing and protruding toward the inside of the container body, and each side plate is a single continuous plate that includes a first portion located on a side face of the protrusion of the internal casing and a second portion located above the protrusion.

2. The container refrigeration apparatus of claim 1, wherein each side plate has a width extending uniformly in a longitudinal direction of the container body.

3. The container refrigeration apparatus of claim 1, wherein the first portion of each side plate is integrated with the side face of the protrusion of the internal casing.

4. The container refrigeration apparatus of claim 1, wherein the internal casing includes a plurality of sheet metal components combined together, and each side plate is one of the sheet metal components.

5. The container refrigeration apparatus of claim 1, both the external casing and the internal casing are made of a metal material, the casing includes intermediate members interposed between the external casing and the internal casing and fixed to the column members and the side plates that correspond to each other, and the intermediate members are made of a resin material having a lower thermal conductivity than the column members and the side plates do.

6. The container refrigeration apparatus of claim 1, wherein the internal casing includes a plurality of sheet metal components combined together, and each side plate is one of the sheet metal components, and is thickest of the sheet metal components.

7. A container refrigeration apparatus comprising:

a casing fitted to an open end of a container body, the casing including an external casing near outside of the container body, and an internal casing near inside of the container body, the internal casing being fixed to the external casing, left and right edge portions of the external casing each including a column member that is continuous from an upper end to a lower end of the casing, left and right edge portions of the internal casing each including a side plate that is provided from the upper end to the lower end of the casing, the side plate positioned on the right edge portion of the internal casing corresponding to the column member positioned on the right edge portion of the external casing, the side plate positioned on the left edge portion of the internal casing corresponding to the column member positioned on the left edge portion of the external casing, the side plates being fixed to the corresponding one of the column members, wherein both the external casing and the internal casing are made of a metal material, the casing includes intermediate members interposed between the external casing and the internal casing and fixed to the column members and the side plates that correspond to each other, and the intermediate members are made of a resin material having a lower thermal conductivity than the column members and the side plates do.

8. The container refrigeration apparatus of claim 7, wherein the internal casing has a protrusion forming part of a lower portion of the casing between the left and right edge portions of the internal casing and protruding toward the inside of the container body.

9. The container refrigeration apparatus of claim 7, wherein, the internal casing has a protrusion forming part of a lower portion of the casing between the left and right edge portions of the internal casing and protruding toward the inside of the container body, and the lower portion of the side plate is integrated with the side face of the protrusion of the internal casing.

10. The container refrigeration apparatus of claim 7, further comprising:

a plurality of fasteners configured to fix each of the column members and each of the side plates that correspond to each other to one of the intermediate members, the fasteners being vertically spaced apart from one another.

11. The container refrigeration apparatus of claim 8, further comprising:

a plurality of fasteners configured to fix each of the column members and each of the side plates that correspond to each other to one of the intermediate members, the fasteners being vertically spaced apart from one another.

12. The container refrigeration apparatus of claim 11, wherein a distance between each adjacent pair of some of the fasteners arranged above the protrusion is shorter than a distance between each adjacent pair of the other fasteners arranged within a range from a lower end to an upper end of the protrusion.

13. The container refrigeration apparatus of claim 9, wherein a plurality of fasteners configured to fix each of the column members and each of the side plates that correspond to each other to one of the intermediate members, the fasteners being vertically spaced apart from one another.

14. The container refrigeration apparatus of claim 13, wherein a distance between each adjacent pair of some of the fasteners arranged above the protrusion is shorter than a distance between each adjacent pair of the other fasteners arranged within a range from a lower end to an upper end of the protrusion.

15. The container refrigeration apparatus of claim 7, wherein the intermediate members each include an internal fastener configured to be fastened to the internal casing.

16. The container refrigeration apparatus of claim 15, wherein the internal casing has plate-shaped edge portions extending in a top-to-bottom direction of the internal casing, and the internal fasteners each have a hook portion extending in the top-to-bottom direction, having a U-shaped cross section, and hooked on an associated one of the plate-shaped edge portions.

17. The container refrigeration apparatus of claim 7, wherein the intermediate members each include an external fastener configured to be fastened to the external casing.

18. The container refrigeration apparatus of claim 17, wherein the column members of the external casing each have a groove extending in a top-to-bottom direction of the external casing, and the external fasteners each have a projection that fits in the groove of an associated one of the column members.

* * * * *